US007815553B2

(12) United States Patent
Song

(10) Patent No.: US 7,815,553 B2
(45) Date of Patent: Oct. 19, 2010

(54) HEALTH MACHINE

(75) Inventor: Eun-Sub Song, Anyang-si (KR)

(73) Assignee: Shin Heung Co., Ltd., Chungcheongnam-do (KR)

( * ) Notice: Subject to any disclaimer, the term of this patent is extended or adjusted under 35 U.S.C. 154(b) by 0 days.

(21) Appl. No.: 12/443,222

(22) PCT Filed: Sep. 28, 2007

(86) PCT No.: PCT/KR2007/004736

§ 371 (c)(1),
(2), (4) Date: Mar. 27, 2009

(87) PCT Pub. No.: WO2008/039013

PCT Pub. Date: Apr. 3, 2008

(65) Prior Publication Data

US 2010/0029447 A1 Feb. 4, 2010

(30) Foreign Application Priority Data

Sep. 29, 2006 (KR) ..... 10-2006-0095854
Sep. 21, 2007 (KR) ..... 20-2007-0015813 U

(51) Int. Cl.
*A63B 21/06* (2006.01)
*A63B 15/00* (2006.01)

(52) U.S. Cl. ..... 482/93; 482/109

(58) Field of Classification Search ..... 482/93, 482/77, 106–108, 109; 294/62
See application file for complete search history.

(56) References Cited

U.S. PATENT DOCUMENTS 3,019,019 A * 1/1962 Forte ..... 482/94
4,489,935 A * 12/1984 Lusk ..... 482/109
4,717,147 A 1/1988 Rochelle
4,936,573 A * 6/1990 Miller ..... 482/118
5,496,240 A * 3/1996 Damm ..... 482/93
5,827,157 A * 10/1998 Lee ..... 482/93
6,386,608 B1 * 5/2002 Eister ..... 294/62
2002/0160888 A1 * 10/2002 Chen et al. ..... 482/77

FOREIGN PATENT DOCUMENTS

KR 20-0362628 Y1 9/2004

* cited by examiner

*Primary Examiner*—Fenn C Mathew
(74) *Attorney, Agent, or Firm*—Sherr & Vaughn, PLLC

(57) ABSTRACT

Provided is a multi-functional health machine which can improve a fixing power of a weight unit in the health machine which can temper various kinds of muscles such as muscles of the upper body and muscles of the waist and the legs, which prevents a connection portion of a support rod which can be selected according to user's physique from seceding due to rotation of a handle portion, and which can reduce a load which is applied to the wrist by making the handle portion rotate according to rotation of the hands to thus make a weight portion placed in a straight line according to the gravitational force of the weight portion. The multi-functional health machine includes: a handle portion (10) on the outer sides of which a pair of grasping rods (11) which a user can hold are respectively formed; a fixing portion (20) to both sides of which the handle portion (10) is fixed; a support rod portion (30) on the upper end of a support rod (31) of which the center of the fixing portion (20) is fixed perpendicularly with the handle portion (10) fixed to the fixing portion (20); and a weight portion (40) in which a plumbing plate (41) of a weight plumb is formed at the lower end of the support rod (31) of the support rod portion (30).

12 Claims, 7 Drawing Sheets

[Fig. 1]
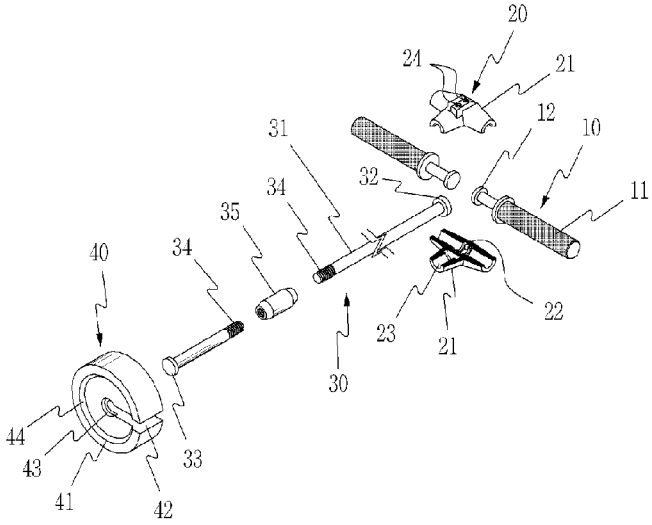
[Fig. 2]
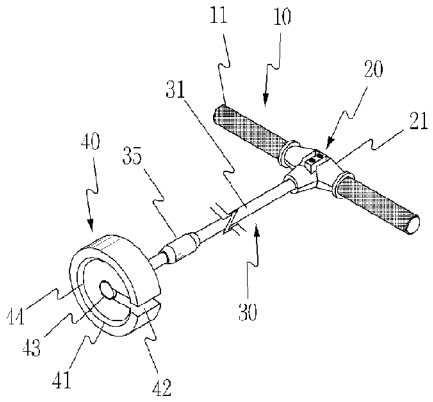
[Fig. 3]
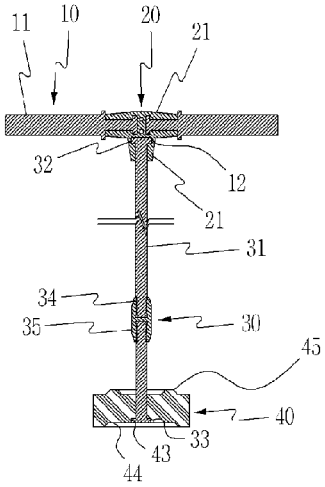

[Fig. 4]
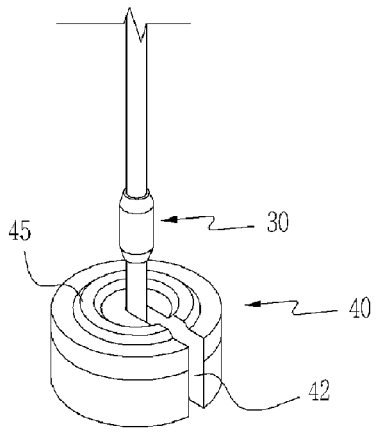
[Fig. 5]
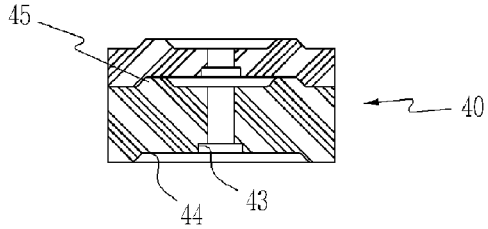
[Fig. 6]
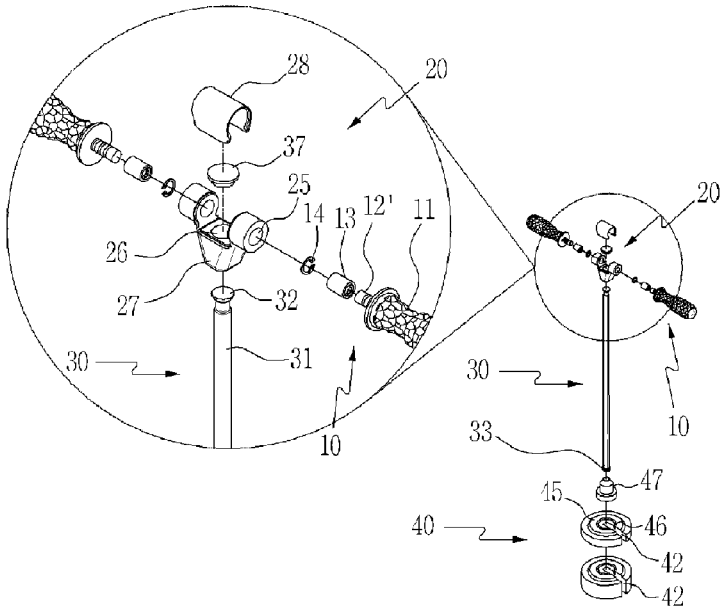

[Fig. 7]
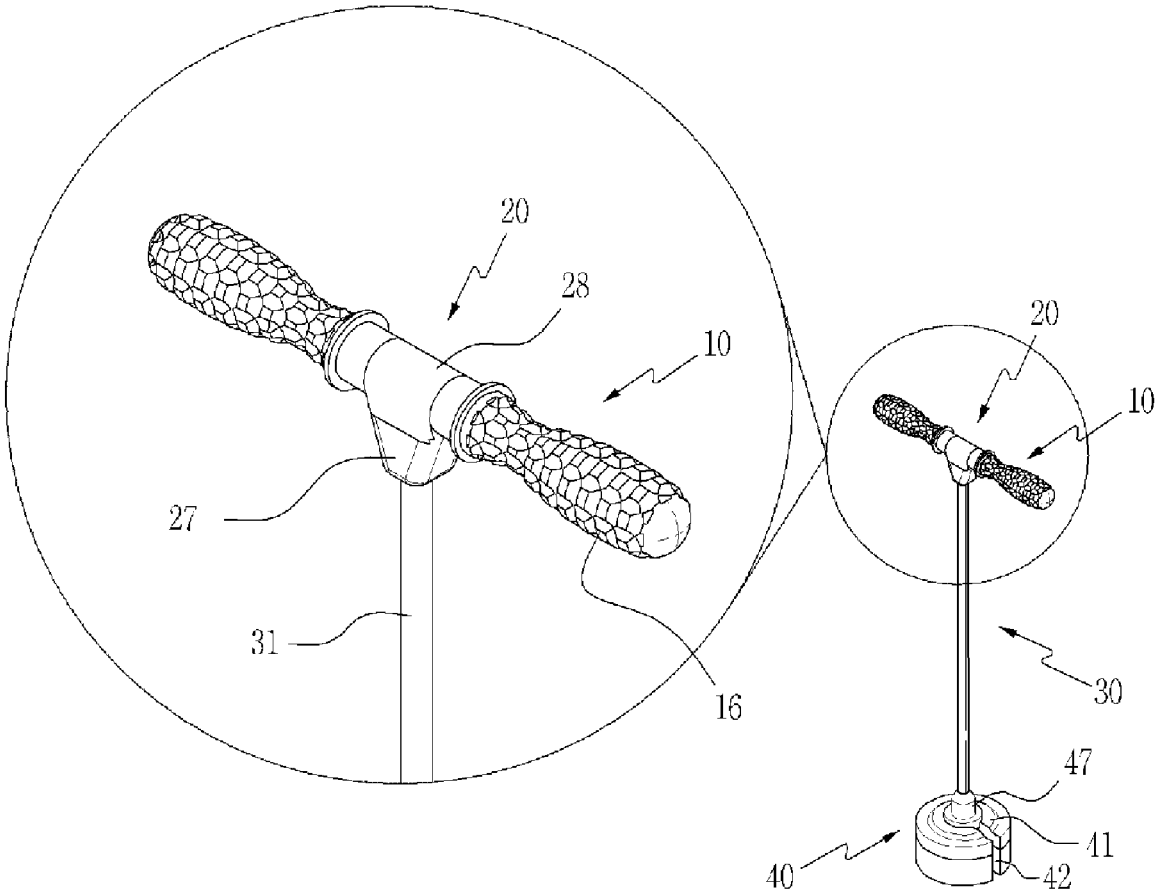

[Fig. 8]
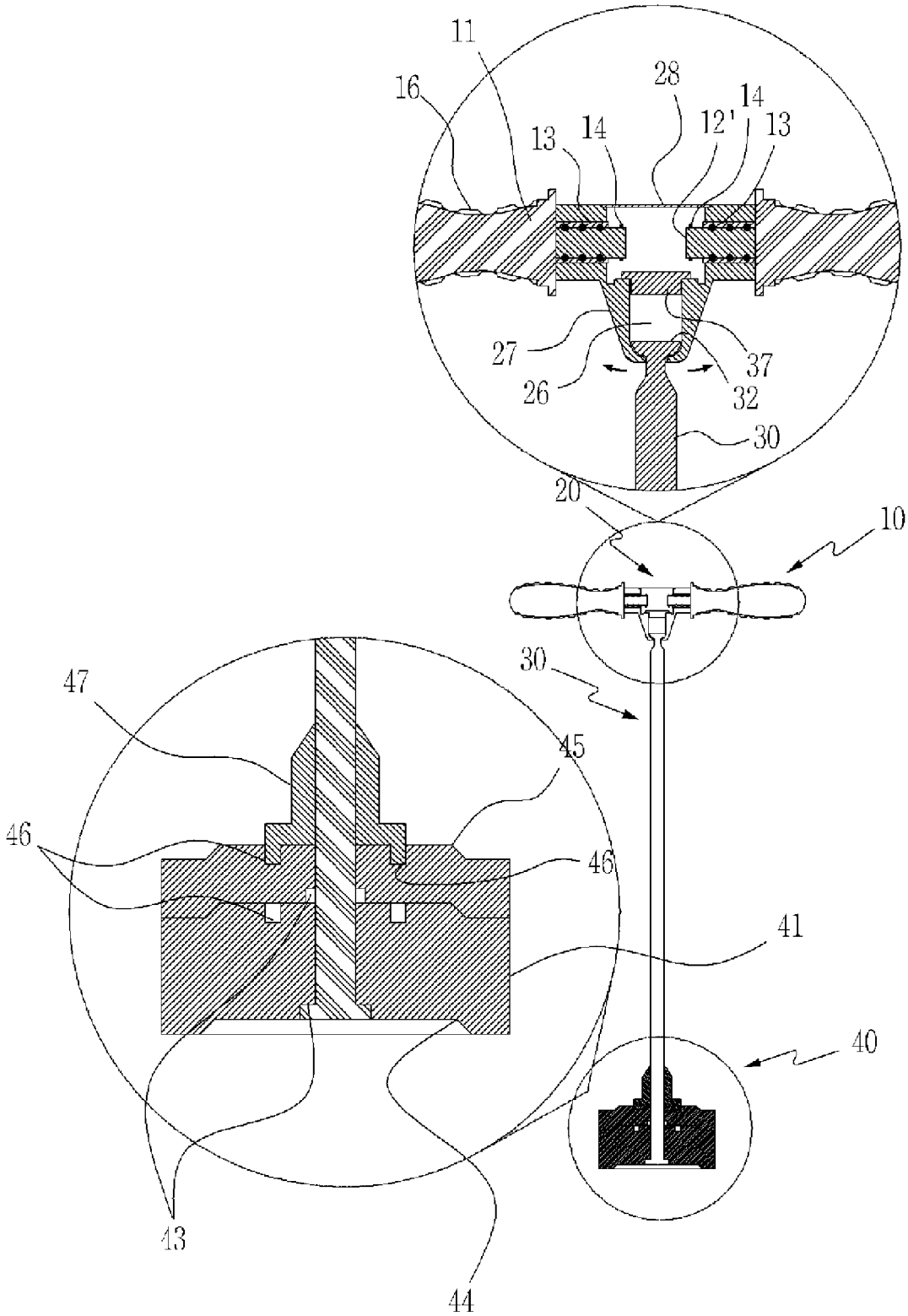

[Fig. 9]
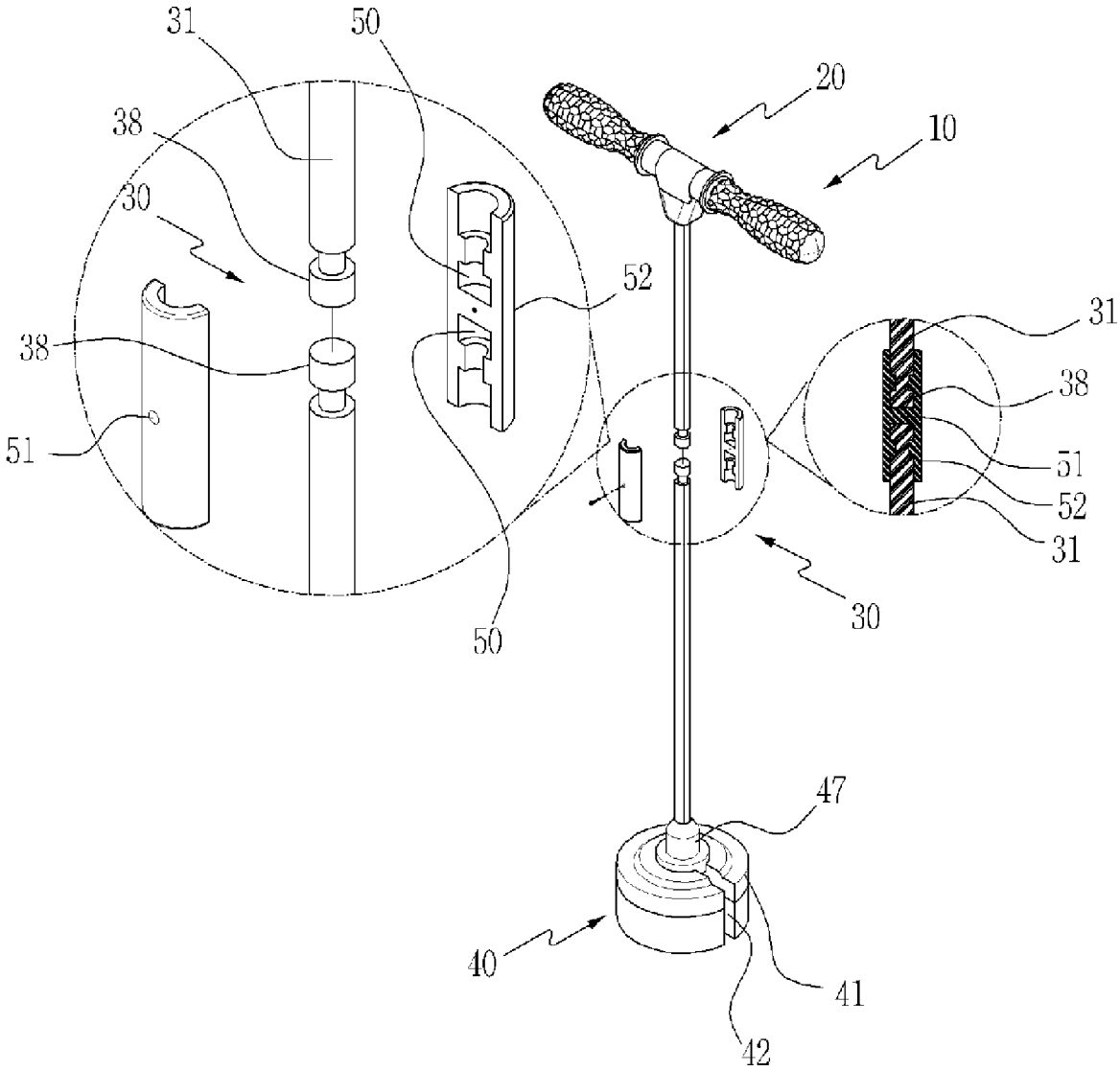

[Fig. 10]
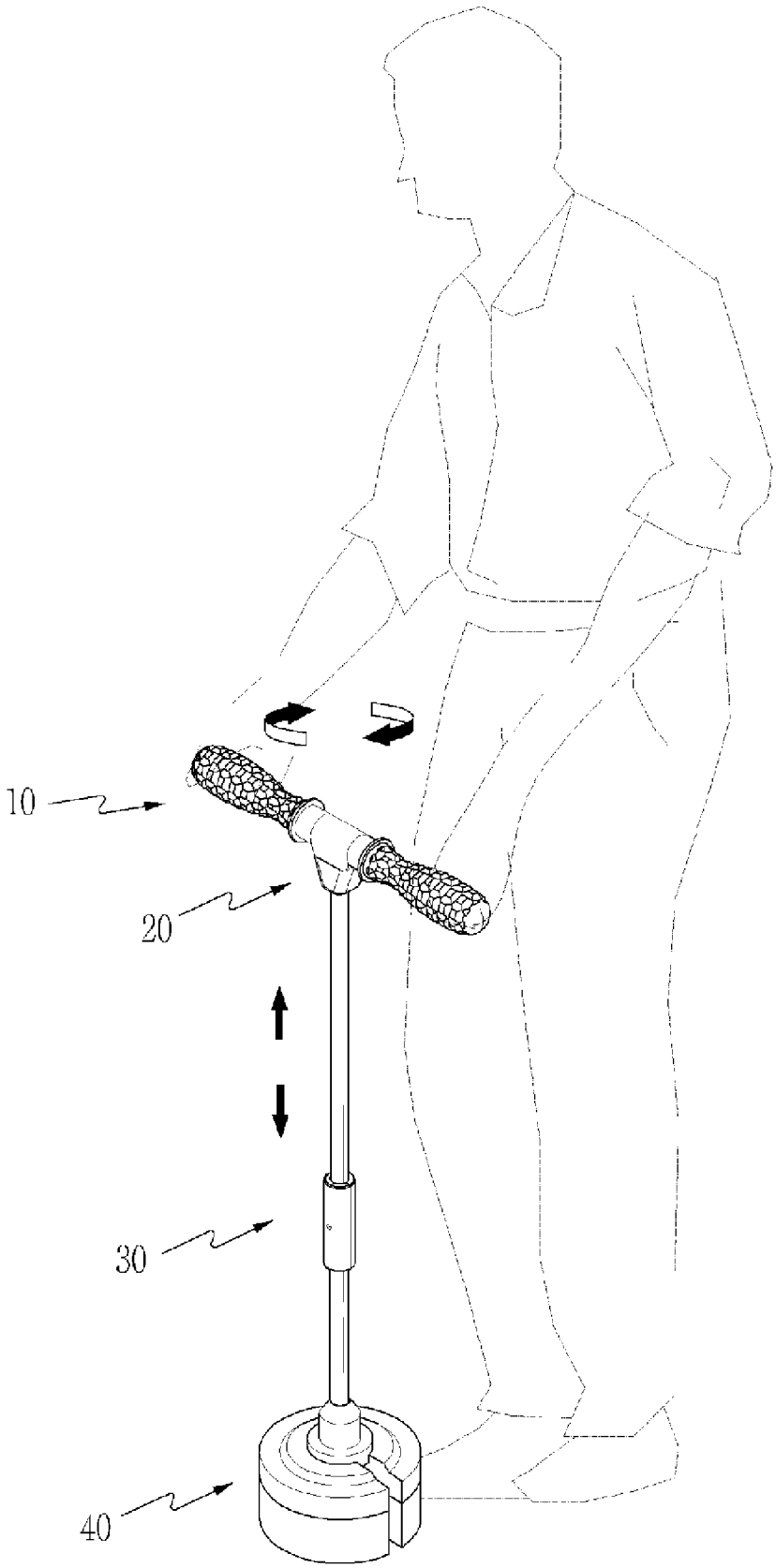

[Fig. 11]
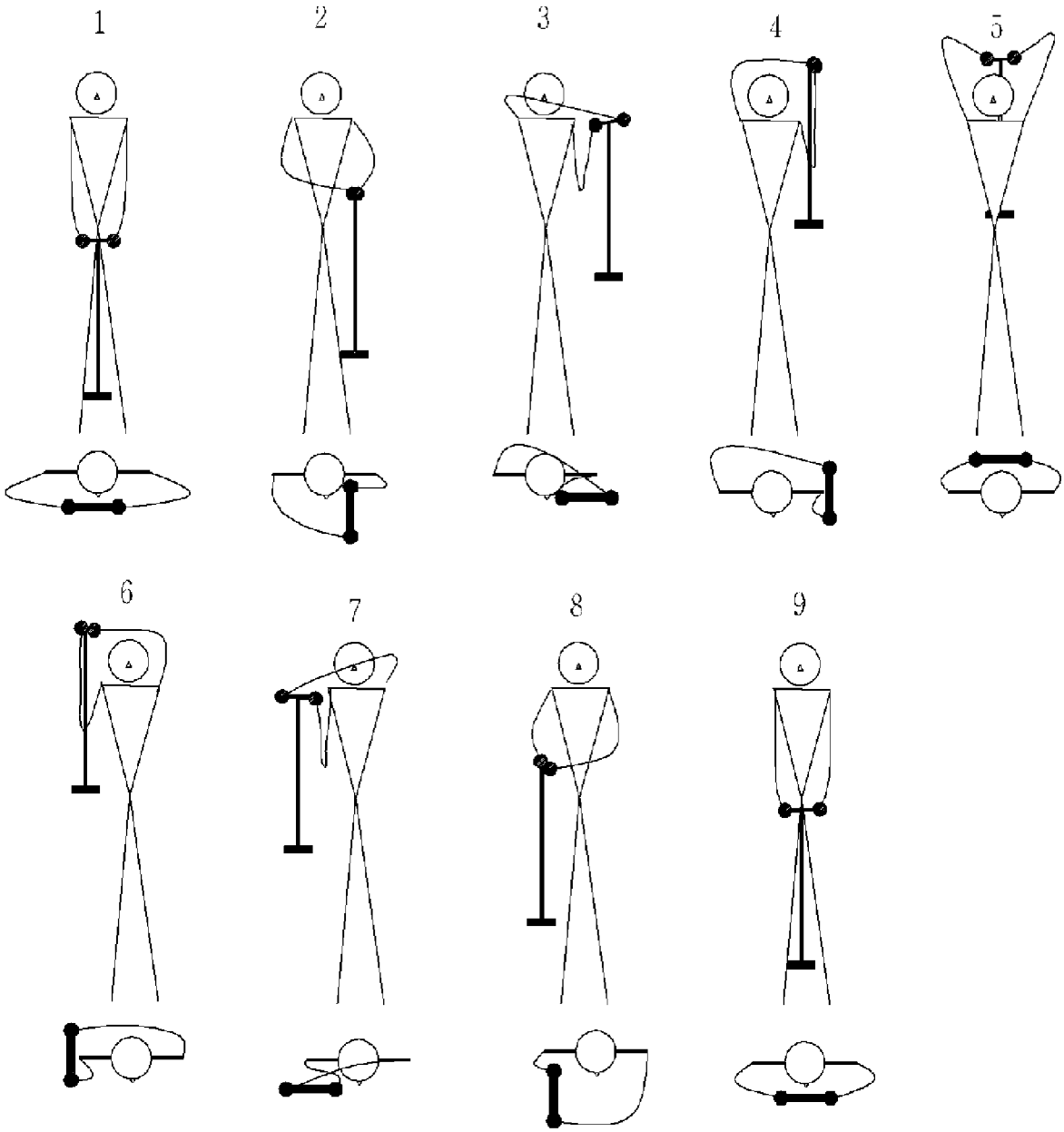

HEALTH MACHINE

TECHNICAL FIELD

The present invention relates to a multi-functional health machine, and more particularly to a multi-functional health machine which can improve a fixing power of a weight unit in the health machine which can temper various kinds of muscles such as muscles of the upper body and muscles of the waist and the legs, which prevents a connection portion of a support rod which can be selected according to user's physique from seceding due to rotation of a handle portion, and which can reduce a load which is applied to the wrist by making the handle portion rotate according to rotation of the hands to thus make a weight portion placed in a straight line according to the gravitational force of the weight portion.

BACKGROUND ART

In general, various kinds of exercises can be divided into aerobic exercises in which most energies consumed for the exercises are supplied by an aerobic metabolism like walking, hypogastric breathing, aerobic jogging, swimming, cycling, climbing, etc., anaerobic exercises which exert a big power in a short time like weight training, throwing, weight lifting, etc., and hybrid exercises in which the aerobic exercises and the anaerobic exercises are mixed.

The aerobic exercises among the above-described exercises are strong rhythmical exercises to thus strengthen a cardiopulmonary function and are suitable for medical treatment of corpulence by using fats as energy sources. The anaerobic exercises improve quickness and softness and heighten the number of the heart pulses, to thereby activate muscles.

In addition, the anaerobic exercises are made by using various health machines. These health machines are classified into an active health machine to which a user applies physical strength directly or which a user activates spontaneously to thus make an exercise, and a passive health machine by the entire operation of which the muscles of a user are released or contracted to thus heighten an exercise effect.

In order to make an aerobic exercise, an anaerobic exercise or a hybrid exercise as described above, people make an exercise by using sports centers such as swimming pools and health clubs and by doing climbing or running.

However, in the case that people use sports centers, they may frequently give up midway and thus do not make an exercise steadily. In the case of climbing or running, they may not frequently make an exercise normally due to the climate and weather conditions.

Therefore, a number of indoor-type multi-functional health machines have been proposed. However, since most of these health machines are of a big volume, respectively, it needs a lot of places to install them indoors. Further, most of these health machines are expensive, many people fail to utilize them.

In addition, a number of health machines that can control momentum according to user's muscular power have been proposed. However, it is impossible to control size of the respective health machines according to user's physical conditions. As a result, since from children to old persons or small women or tall men cannot use the health machines together, there is a problem that various sizes of health machines should be purchased.

DISCLOSURE OF INVENTION

Technical Problem

Therefore, to solve the above problems, it is an object of the present invention to provide a multi-functional health machine which enables users to make various kinds of exercises in order to temper various kinds of muscles such as muscles of arms, muscles of the upper body and muscles of the waist and the legs, which can adjust size of the health machine and can make users select strength of an exercise, according to user's physical conditions.

It is another object of the present invention to provide a multi-functional health machine whose volume is small and whose disassembly and assembly is conveniently performed, to thus make carriage and storage of the health machine convenient and whose structure is simple, to thus lower a purchase expense and enable people to easily make an exercise even in a narrow exercise space such as homes or offices.

Technical Solution

To accomplish the above object of the present invention, according to a first aspect of the present invention, there is provided a multi-functional health machine comprising:

a handle portion on the outer sides of which grasping rods which a user can hold are respectively formed and in the ends of the inner side of which a rotary ring having a larger diameter than that of the respective grasping rods is respectively formed;

a fixing portion at both sides of the inner portion formed by a pair of fixing plates of which handle rotating grooves are formed so that the rotary rings of the handle portion can be inserted, at the inner-central portions of the handle rotating grooves formed in the fixing plates of which support rod rotating grooves are vertically formed, and thus at the center of which a fixing hole is formed so that the pair of fixing plates overlap to then be fixed;

a support rod portion on the upper end of which a rotating rim having a larger diameter than that of a support rod in the support rod portion is formed and at the lower end of which a stopper is formed so that the support rod is inserted into and rotated in the support rod rotating grooves of the fixing portion; and a weight portion from the center of a plumbing plate of which to the outer circumference of the plumbing plate of which an insertion groove is formed so that the support rod in the support rod portion is inserted into the insertion groove.

In addition, a spiral portion is formed at the center of the support rod in the support rod portion, and a coupling is formed to be combined with the spiral portion.

In addition, a locking groove is formed on the bottom of the plumbing plate of the weight portion so that the stopper of the support rod portion is inserted into the locking groove.

In addition, a coupling groove is formed in the outer circumference of the locking groove, and a coupling protrusion is formed so as to correspond to the coupling groove.

Meanwhile, according to a second aspect of the present invention, there is also provided a multi-functional health machine comprising:

a handle portion on the outer sides of which grasping rods which a user can hold are respectively formed and in the ends of the inner side of which rotary rods are respectively formed, in which the outer circumference of the respective rotary rods are inserted into a bearing and a fixing ring is coupled with the end of the respective rotary rods so that the bearings do not secede from the rotary rods;

a fixing portion at both sides of a fixing body of which handle holes are horizontally formed so that the rotary rods of the handle portion are inserted and rotated, at the center of the handle holes formed in the fixing body of which a support rod hole is vertically formed, and between the handle holes which are located at the upper side of the support rod hole of the fixing body of which a cover is formed;

a support rod portion on the upper end of a support rod of which a locking surface is formed so as to be inserted into the support rod hole of the fixing portion and to then be locked and fixed on the bottom of the support rod hole; and a weight portion from the center of a plumbing plate of which to the outside of the plumbing plate of which an open insertion groove is formed and at the center of the plumbing plate of which a locking groove is formed, so that the support rod in the support rod portion is inserted into the insertion groove, on the upper side of the plumbing plate of which a coupling protrusion is formed and on the lower side of the plumbing plate of which a coupling groove is formed in which the coupling protrusion and the coupling groove correspond to each other, and at the center of the plumbing plate of which a secession preventive groove is formed in which the end of a secession preventive ring into which the support rod is inserted and which descends and ascends along the support rod, is inserted into the secession preventive groove, to thereby make the plumbing plate fixed.

In addition, the locking surface which is formed on the upper end of the support rod in the support rod portion which surface-contacts the support rod hole of the fixing portion and the bottom of the support rod hole is formed in a semi-circular shape so that the support rod can rotate.

In addition, a lid is formed on the upper side of the support rod hole.

In addition, the central portion of the support rod in the support rod portion is cut and a locking annular rim is formed at both ends of the cut portion, respectively.

In addition, a pair of coupling pieces at the inner side of which a coupling groove is formed and at the center of which a coupling hole is formed in correspondence to the locking annular rims formed at both ends of the cut portion of the support rod, are formed to couple the locking annular rims.

ADVANTAGEOUS EFFECTS

As described above, a multi-functional health machine according to the present invention improves a fixing power of the weight portion, by fixing the upper and lower surfaces of a weight unit in the health machine which can temper various kinds of muscles such as muscles of the upper body and muscles of the waist and the legs, prevents a connection portion of a support rod from seceding due to rotation of a handle portion, and protects joints of a user by making the handle portion rotate according to rotation of the hands to thus make a weight portion placed in a straight line according to the gravitational force of the weight portion.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

BRIEF DESCRIPTION OF THE DRAWINGS

The above and/or other objects and/or advantages of the present invention will become more apparent by describing the preferred embodiments thereof in detail with reference to the accompanying drawings in which:

FIG. 1 is an exploded perspective view showing a multi-functional health machine according to a first embodiment of the present invention;

FIG. 2 is an assembled perspective view showing the multi-functional health machine according to the first embodiment of the present invention;

FIG. 3 is a cross-sectional view showing the multi-functional health machine according to the first embodiment of the present invention;

FIG. 4 is a perspective view showing a weight portion in the multi-functional health machine according to the first embodiment of the present invention;

FIG. 5 is a cross-sectional view showing the weight portion in the multi-functional health machine according to the first embodiment of the present invention;

FIG. 6 is an exploded perspective view showing a multi-functional health machine according to a second embodiment of the present invention;

FIG. 7 is an assembled perspective view showing the multi-functional health machine according to the second embodiment of the present invention;

FIG. 8 is a cross-sectional view showing the multi-functional health machine according to the second embodiment of the present invention;

FIG. 9 is a perspective view for explaining the multi-functional health machine according to the second embodiment of the present invention; and FIGS. 10 and 11 are diagrams illustrating a state of using the multi-functional health machine according to the present invention.

BEST MODE FOR CARRYING OUT THE INVENTION

Hereinbelow, a multi-functional health machine according to respective preferred embodiments of the present invention will be described with reference to the accompanying drawings. Like reference numerals denote like elements through the following embodiments.

FIGS. 1 to 3 are an exploded perspective view, an assembled perspective view, and a cross-sectional view showing a multi-functional health machine according to a first embodiment of the present invention, respectively.

As shown in FIGS. 1 to 3, the multi-functional health machine according to the present invention, includes: a handle portion 10 on the outer sides of which grasping rods 11 which a user can hold are respectively formed; a fixing portion 20 to both sides of which the handle portion is fixed; a support rod portion 30 on the upper end of a support rod 31 of which the center of the fixing portion 20 is fixed perpendicularly with the handle portion 10 fixed to the fixing portion 20; and a weight portion 40 in which a plumbing plate 41 of a weight plumb is formed at the lower end of the support rod 31 of the support rod portion 30.

In the handle portion 10, the grasping rods 11 which a user can hold are respectively formed on the outer sides of the handle portion 10 and a rotary ring 12 having a larger diameter than that of the respective grasping rods 11 is respectively formed in the ends of the inner side of the handle portion 10.

The outer sides of the respective grasping rods 11 of the handle portion 10 are formed of rubber rings in order to avoid a slippery phenomenon. In addition, in order to prevent the hands of a user from being inserted into the fixing portion 20, that is, from being hurt, it is preferable that diameter of the rubber ring 12 is larger than that of the respective grasping rods 11.

The fixing portion 20 is formed so that the rotary ring 12 of the handle portion 10 is inserted.

In the fixing portion 20, handle rotating grooves 22 are formed at both sides of the inner portion formed by a pair of fixing plates 21 of the fixing portion 20, so that the handle portion 10 vertically rotates at the state where the handle portion 10 is fixed to the handle rotating grooves 22.

Support rod rotating grooves 23 are vertically formed at the inner-central portions of the handle rotating grooves 22 formed in the fixing plates 20 of the fixing portion 20, and thus a fixing hole 24 is formed at the center of the fixing portion 20 so that the pair of fixing plates 21 overlap to then be fixed.

The support rod portion 30 is formed to be inserted into the support rod rotating grooves 23 of the fixing portion 20 to then be rotated.

In the support rod portion 30, a rotating rim 32 having a larger diameter than that of the support rod 31 in the support rod portion 30 is formed on the upper end of the support rod portion 30, so that the support rod 31 is inserted into and rotated in the support rod rotating grooves 23 of the fixing portion 20, and a stopper 33 is formed at the lower end of the support rod portion 30.

The weight portion 40 is formed so that the support rod 31 in the support rod portion 30 is inserted into the weight portion 40, to thus enable a user to make an exercise using an appropriate weight according to his or her physique.

In the weight portion 40, an insertion groove 42 is formed from the center of a plumbing plate of the weight portion 40 to the outer circumference of the plumbing plate of the weight portion 40.

Meanwhile, as shown in FIGS. 3 and 4, the support rod 31 in the support rod portion 30 is cut into two pieces at the central portion thereof, and a spiral portion 34 is respectively formed at the ends of the two pieces of the cut support rod 31 in the support rod portion 30. A coupling 35 is formed to be combined with the spiral portions 34 of the respective two pieces of the support rod 31.

As shown in FIGS. 4 and 5, a locking groove 43 is formed on the bottom of the plumbing plate 41 of the weight portion 40 so that the stopper 33 of the support rod portion 30 is inserted into the locking groove 43. In addition, a coupling groove 44 is formed in the outer circumference of the locking groove 43, and a coupling protrusion 45 is formed so as to correspond to the coupling groove 44.

Meanwhile, FIG. 6 is an exploded perspective view showing a multi-functional health machine according to a second embodiment of the present invention. FIG. 7 is an assembled perspective view showing the multi-functional health machine according to the second embodiment of the present invention. FIG. 8 is a cross-sectional view showing the multi-functional health machine according to the second embodiment of the present invention.

As shown in FIGS. 6 to 8, a multi-functional health machine according to a second aspect of the present invention, includes a handle portion 10, a fixing portion 20, a support rod portion 30, and a weight portion 40, in the same manner as that of the first aspect of the present invention.

As shown in FIGS. 6 to 8, grasping rods 11 which a user can hold are respectively formed on the outer sides of the handle portion 10 and rotary rods 12' are respectively formed in the ends of the inner side of the handle portion 10.

Finger pressure protrusions 16 are formed around the outer circumferences of the grasping rods 11, so that the fingers of a user can be pressed when he or she holds the grasping rods 11.

In addition, the outer circumference of the respective rotary rods 12' are inserted into a bearing 13, and a fixing ring 14 is coupled with the end of the respective rotary rods 12' so that the bearings 13 do not secede from the rotary rods 12'.

The fixing portion 20 is formed so that the rotary rods 12' of the handle portion 10 is inserted into the fixing portion 20 to then be fixed.

In the fixing portion 20, handle holes 25 are horizontally formed at both sides of a fixing body of the fixing portion 20 so that the rotary rods 12' of the handle portion 10 are inserted and rotated, a support rod hole is vertically formed at the center of the handle holes 25 formed in the fixing body 27 of the fixing portion 20, and a cover 28 is formed in a predetermined space formed at the upper side of the support rod hole 26 which is located at the center of the handle holes 25.

The upper end of the support rod portion 30 is inserted into the support rod hole 26 of the fixing portion 20.

In the support rod portion 30, a locking surface 32 is formed on the upper end of a support rod 31 in the support rod portion 30 so as to be inserted into the support rod hole 26 of the fixing portion 20 and to then be locked and fixed on the bottom of the support rod hole 26.

In addition, the locking surface 32 which is formed on the upper end of the support rod 31 in the support rod portion 30 which surface-contacts the support rod hole 26 of the fixing portion 20 and the bottom of the support rod hole 26 is formed in a semi-circular shape so that the support rod 31 can rotate. In addition, a lid 37 is formed on the upper side of the support rod hole 26.

The weight portion 40 is formed in order to maintain a weight so that a user can make an exercise, in which a stopper 33 which is formed at the lower end of the support rod 31 in the support rod portion 30 is inserted into the weight portion 40.

In the weight portion 40, an insertion groove 42 is formed from the center of a plumbing plate 41 of the weight portion 40 to the outside of the plumbing plate 41 of the weight portion 40 so that the support rod 31 in the support rod portion 30 is inserted into the insertion groove 42 and a locking groove 43 is formed at the center of the plumbing plate 41 of the weight portion 40.

A coupling protrusion 45 is formed on the upper side of the plumbing plate 41 of the weight portion 40 and a coupling groove 44 is formed on the lower side of the plumbing plate 41 thereof, in which the coupling protrusion 45 and the coupling groove 44 correspond to each other, to thus enable a user to use a plurality of the plumbing plates 41 to overlap each other. A secession preventive groove 46 is formed at the center of the plumbing plate 41 in which a secession preventive ring 47 into which the support rod 31 is inserted and which descends and ascends along the support rod 31, is inserted into the secession preventive groove 46, to thereby make the plumbing plate 41 fixed and thus improve a fixing power of the plumbing plate 41.

Meanwhile, as shown in FIG. 9, the central portion of the support rod 31 in the support rod portion 30 is cut into two pieces and locking annular rims 38 are formed at both ends of the cut portion, respectively.

In addition, a pair of coupling pieces 52 at the inner side of which a coupling groove 50 is formed and at the center of which a coupling hole 51 is formed in correspondence to the locking annular rims 38 formed at both ends of the cut portion of the support rod 31, are formed to couple the locking annular rims 38. Accordingly, length of the support rod portion 30 can be adjusted by replacing the support rod 31 with another one. Further, the pair of coupling pieces 52 prevent the support rod 31 from seceding by rotation of the handle portion.

MODE FOR THE INVENTION

Functions and effects of the multi-functional health machines according to the first and second aspects of the present invention having the above-described structures will follow.

First, in the multi-functional health machine according to the first aspect of the present invention, the rotary rings 12 of the handle portion 10 are inserted into the handle rotation grooves 22 formed in the fixing plates 21 of the fixing portion 20, and the rotating rim 32 which is formed on the upper end of the support rod 31 in the support rod portion 30 is inserted into the support rod rotating grooves 23 of the fixing portion 20. A pair of the fixing plates 21 are fixed via the fixing hole 24 with fixing bolts.

In this state, the support rod 31 which is long appropriately for user's physique is spirally fixed to the coupling 35.

As described above, the support rod 31 is inserted into the insertion groove 42 formed at the plumbing plate 41 of the weight portion 40 having the respective weights so as to control a kinetic energy of a user at the lower end of the support rod 31 and is located at the center of the plumbing plate 41.

As described above, if the plumbing plate 41 is located at the center of the plumbing plate 41, the stopper 33 formed at the lower end of the support rod 31 is inserted into the locking groove 43 which is formed on the bottom of the plumbing plate 41 of the weight portion 40. Accordingly, a user can make an exercise at the state where the support rod 31 is fixed the weight portion 40.

In order to heighten an exercise effect of the health machine according to the present invention, a plurality of the plumbing plates 41 can be used while overlapping. When a plurality of the plumbing plates 41 are used while overlapping, a coupling protrusion 45 which is formed on the upper surface of the plumbing plate 41 is fitted into a coupling groove 44 which is formed on the lower surface of the plumbing plate 41, to thereby prevent the plumbing plate 41 from falling down.

Meanwhile, in the multi-functional health machine according to the second aspect of the present invention, the respective rotary rods 12' of the handle portion 10 are inserted into a bearing 13.

In this state, the respective rotary rods 12' is inserted into the handle holes 25, and the fixing ring 14 is coupled with the end of the respective rotary rods 12' so that the bearings 13 do not secede from the rotary rods 12'.

In addition, the locking surface 32 which is formed on the upper end of the support rod 31 in the support rod portion 30 which surface-contacts the support rod hole 26 of the fixing portion 20 and the bottom of the support rod hole 26 is formed in a semi-circular shape so that the support rod 31 can rotate according to the gravitational force of the support rod 31. In addition, a lid 37 is provided on the upper side of the support rod hole 26, in order to intercept dust due to a wear which occurs by rotation of the support rod 31.

In this state, the support rod 31 which is long appropriately for user's physique is inserted into the coupling groove 50 in the coupling piece 52 and fixed via the coupling hole 51.

As described above, the support rod 31 is inserted into the insertion groove 42 formed at the plumbing plate 41 of the weight portion 40 having the respective weights so as to control a kinetic energy of a user at the lower end of the support rod 31 and is located at the center of the plumbing plate 41.

As described above, if the plumbing plate 41 is located at the center of the plumbing plate 41, the stopper 33 formed at the lower end of the support rod 31 is inserted into the locking groove 43 which is formed on the bottom of the plumbing plate 41 of the weight portion 40. Accordingly, a user can make an exercise at the state where the support rod 31 is fixed the weight portion 40.

In order to heighten an exercise effect of the health machine according to the present invention, a plurality of the plumbing plates 41 can be used while overlapping. When a plurality of the plumbing plates 41 are used while overlapping, a coupling protrusion 45 which is formed on the upper surface of the plumbing plate 41 is fitted into a coupling groove 44 which is formed on the lower surface of the plumbing plate 41, to thereby prevent the plumbing plate 41 from falling down.

In addition, in the case of the plumbing plate 41 which is located at the uppermost position of the plurality of the plumbing plates 41, the secession preventive protrusion 47 which descends and ascends along the support rod 31 is inserted into and fixed to the secession preventive groove 46 which is formed at the center of the upper surface of the plumbing plate 41.

Meanwhile, the locking annular rims 38 formed at the respective ends of the separated support rods 31 are inserted into the coupling grooves 50 of the coupling pieces 52, respectively, and the coupling pieces 52 are coupled in opposition to each other. Accordingly, it is prevented that the support rod is dismantled due to rotation of the health machine.

INDUSTRIAL APPLICABILITY

As described above, a multi-functional health machine according to the present invention may be used as illustrated in FIG. 10. As shown, a user grasps the handle portion, spreads the arms by the shoulder width, bends the laps a little, and makes an exercise using the hands and wrists, with both the hands hold the handle portion of the health machine, as in an exercise using barbells.

The handle portion 10 in the multi-functional health machine according to the present invention rotates in the handle holes 21 of the fixing portion 20, to thus protect the wrists of the user. The support rod portion 30 also rotates along the semi-circular shape of the locking surface 32 formed in the upper end of the support rod 31 in order to maintain verticality in the gravitational direction.

Therefore, as shown in FIG. 11 which shows a variety of states of using the multi-functional health machine according to the present invention, the handle portion keeps horizontal and the support rod portion and the weight portion keep vertical. Accordingly, the user can rotate the multi-functional health machine slowly and within a circle as large as possible. Thus, the user can make an exercise of the upper body as well as the waist. In addition, in the case that a short support rod is used, the short support rod is put on the ankle to make various kinds of exercises of the legs etc.

The invention claimed is:

1. A multi-functional health machine comprising:

a handle portion including inner and outer sides, and a pair of grasping rods which a user can hold formed on the outer sides of the handle portion;

a fixing portion including two sides, the handle portion being fixed to the two sides of the fixing portion;

a support rod having an upper portion and a lower end, the center of the fixing portion fixed perpendicularly to the upper portion of the support rod; and a weight portion including a plumbing plate of a weight plumb attached to the lower end of the support rod, wherein the handle portion includes rotary rings on inner sides of the grasping rods, each rotary ring having a larger diameter than that of the respective grasping rods;

wherein the fixing portion is formed by a overlapping pair of fixing plates defining handle rotating grooves sized to accommodate the rotary rings of the handle portion, and further defining support rod rotating grooves and a central support rod fixing hole;

wherein the support rod includes a rotating rim on the upper end, the rotating rim having a larger diameter than a diameter of a central portion of the support rod, the rotating rim sized to fit in the support rod rotating grooves, and wherein a stopper is formed at the lower end of the support rod; and wherein an insertion groove is formed from the center to the outer circumference of the plumbing plate of the weight portion, and wherein the support rod is inserted into the insertion groove.

2. The multi-functional health machine according to claim 1, wherein the support rod is cut into two pieces at the central portion thereof, a spiral portion is respectively formed at the ends of the two pieces of the cut support rod, and a coupling is formed to be combined with the spiral portions of the respective two pieces of the support rod.

3. The multi-functional health machine according to claim 1, wherein a locking groove is formed on the bottom of the plumbing plate of the weight portion so that the stopper of the support rod is inserted into the locking groove, a coupling groove is formed in the outer circumference of the locking groove, and a coupling protrusion is formed so as to correspond to the coupling groove.

4. The multi-functional health machine according to claim 1, wherein finger pressure protrusions are formed around the outer circumferences of the grasping rods.

5. The multi-functional health machine according to claim 1, wherein a locking surface with a semi-circular shape is formed on the upper end of the support rod so that the support rod can rotate, and wherein a lid is formed on the upper side of the support rod hole.

6. The multi-functional health machine according to claim 1, wherein a central portion of the support rod is cut into two pieces, and locking annular rims are formed at both ends of the cut portion, respectively, and wherein a coupling groove is formed at the inner side of a pair of coupling pieces and at the center of which a coupling hole is formed in correspondence to the locking annular rims formed at both ends of the cut portion of the support rod, are formed to couple the locking annular rims.

7. A multi-functional health machine comprising:

a handle portion including inner and outer sides, and a pair of grasping rods which a user can hold formed on the outer sides of the handle portion;

a fixing portion including two sides, the handle portion being fixed to the two sides of the fixing portion;

a support rod having an upper portion and a lower end, the center of the fixing portion fixed perpendicularly to the upper portion of the support rod; and a weight portion including a plumbing plate of a weight plumb attached to the lower end of the support rod, wherein the ends of the inner sides of the handle portion includes rotary rods, the outer circumference of the rotary rods are inserted into a bearing, and a fixing ring is coupled with the end of the respective rotary rods so that the bearings do not secede from the rotary rods;

wherein the fixing portion defines horizontal handle holes formed at both sides of a fixing body so that the rotary rods of the handle portion are rotatably contained, and the fixing portion defines a vertical support rod hole at the center of the handle holes formed in the fixing body;

wherein the upper end of the support rod includes a locking surface formed to fit into the support rod hole of the fixing portion and to be locked and fixed on the bottom of the support rod hole; and wherein an open insertion groove is formed from the center to the outside of the plumbing plate of the weight portion, the pluming plate having a locking groove formed therein, and wherein the support rod is inserted into the insertion groove, and wherein a coupling protrusion is formed on the upper side of the plumbing plate and a coupling groove is formed on the lower side of the plumbing plate, such that the coupling protrusion and the coupling groove correspond to each other, and a secession preventive groove is formed at the center of the plumbing plate wherein the end of a secession preventive ring into which the support rod is inserted and which descends and ascends along the support rod, is inserted into the secession preventive groove, to thereby fix the plumbing plate.

8. The multi-functional health machine according to claim 7, wherein the support rod is cut into two pieces at the central portion thereof, a spiral portion is respectively formed at the ends of the two pieces of the cut support rod, and a coupling is formed to be combined with the spiral portions of the respective two pieces of the support rod.

9. The multi-functional health machine according to claim 7, wherein a locking groove is formed on the bottom of the plumbing plate of the weight portion so that the stopper of the support rod is inserted into the locking groove, a coupling groove is formed in the outer circumference of the locking groove, and a coupling protrusion is formed so as to correspond to the coupling groove.

10. The multi-functional health machine according to claim 7, wherein finger pressure protrusions are formed around the outer circumferences of the grasping rods.

11. The multi-functional health machine according to claim 7, wherein the locking surface formed on the upper end of the support rod is formed in a semi-circular shape so that the support rod can rotate, and wherein a lid is formed on the upper side of the support rod hole.

12. The multi-functional health machine according to claim 7, wherein a central portion of the support rod is cut into two pieces, and locking annular rims are formed at both ends of the cut portion, respectively, and wherein a coupling groove is formed at the inner side of a pair of coupling pieces and at the center of which a coupling hole is formed in correspondence to the locking annular rims formed at both ends of the cut portion of the support rod, are formed to couple the locking annular rims.

* * * * *